US006398412B2

(12) United States Patent
Wedi et al.

(10) Patent No.: US 6,398,412 B2
(45) Date of Patent: Jun. 4, 2002

(54) GUSSETED BAG MADE OF A FLEXIBLE WELDABLE MATERIAL

(75) Inventors: Johannes Wedi, Emsdetten; Rolf Dewert, Ladbergen, both of (DE)

(73) Assignee: Bischof und Klein & Co. KG, Lengerich (DE)

( * ) Notice: Subject to any disclaimer, the term of this patent is extended or adjusted under 35 U.S.C. 154(b) by 0 days.

(21) Appl. No.: 09/880,495

(22) Filed: Jun. 13, 2001

(30) Foreign Application Priority Data

Oct. 6, 2000 (DE) ..... 200 17 182 U

(51) Int. Cl.[7] ..... B65D 33/18; B65D 30/20

(52) U.S. Cl. ..... 383/211; 383/61; 383/63; 383/95; 383/120

(58) Field of Search ..... 383/120, 61, 63, 383/211, 95

(56) References Cited

U.S. PATENT DOCUMENTS

| | | | | | |
|---|---|---|---|---|---|
| 5,080,253 | A | * | 1/1992 | Zieke | 383/63 |
| 5,364,189 | A | * | 11/1994 | Kuge et al. | 383/61 |
| 6,030,123 | A | * | 2/2000 | Mitarai | 383/63 |
| 6,186,663 | B1 | * | 2/2001 | Ausnit | 383/63 |

* cited by examiner

*Primary Examiner*—Stephen P. Garbe
(74) *Attorney, Agent, or Firm*—Jordan and Hamburg LLP

(57) ABSTRACT

A gusseted bag made of a flexible weldable material has a closed bottom end that at the inside top end is provided with a reclosable device. Side gussets are inserted between the two bag walls that form the front bag wall and the rear bag wall to stretch from the bottom end to the top end and terminate at a distance below the upper edge of the bag walls and thus define a top area of the bag without side gussets. The reclosable device is formed between the two bag walls, the upper ends of the side gussets being closed by welding to themselves and reach freely into the interior space of the bag underneath the reclosable device.

12 Claims, 3 Drawing Sheets

GUSSETED BAG MADE OF A FLEXIBLE WELDABLE MATERIAL

BACKGROUND OF THE INVENTION

Figure 1:
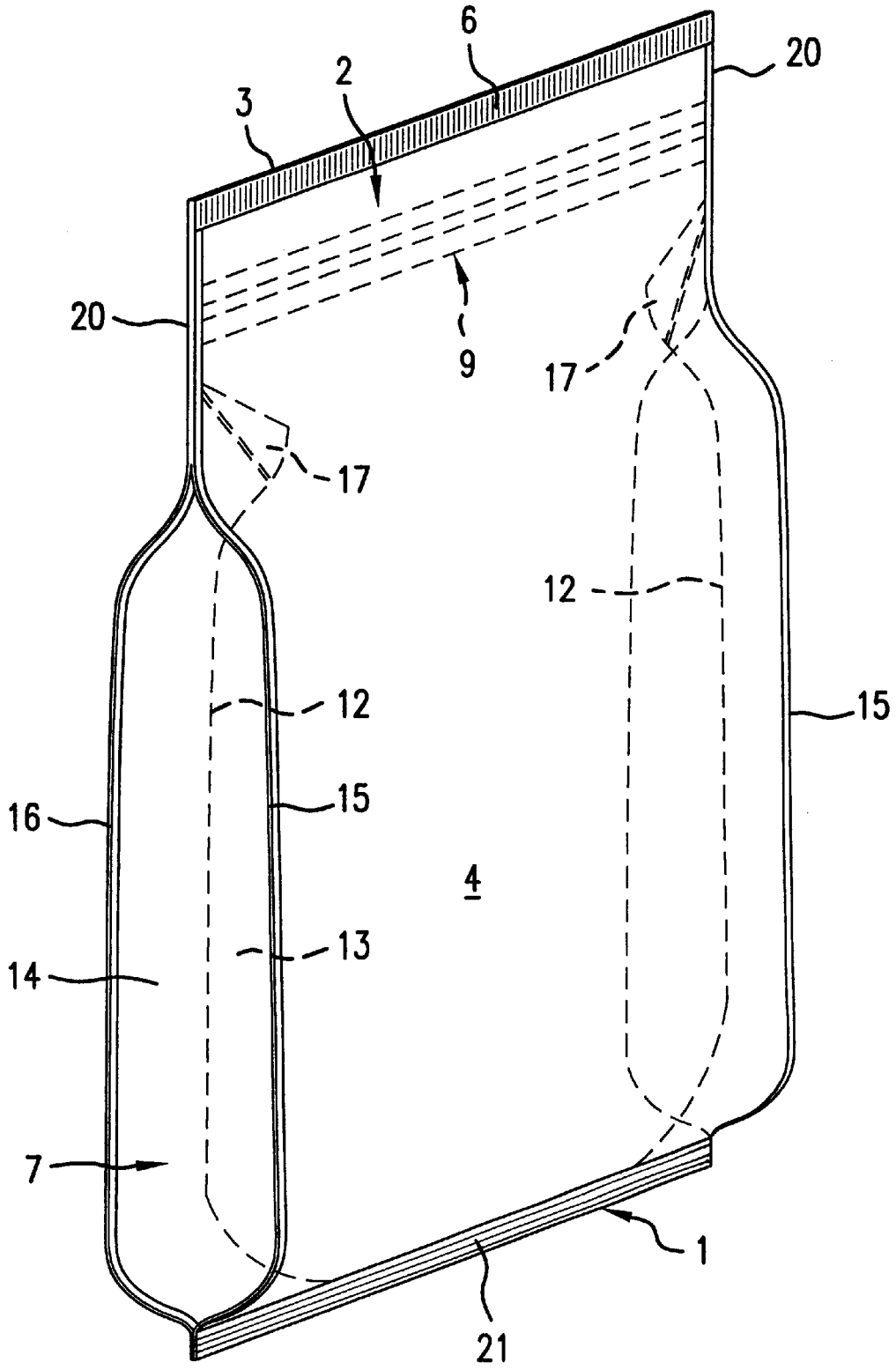

The invention relates to a gusseted bag made of a flexible weldable material with a closed bottom end that at the inside top end is provided with a reclosable device, where side gussets that are inserted between the two bag walls that form the front bag wall and the rear bag wall stretch from the bottom end to the top end and terminate at a distance below the upper edge of the bag walls and thus define a top area of the bag without side gussets, where the reclosable device is formed between the two bag walls.

Gusseted bags of this kind are used for packing various fill materials in piece, granule or powder form that are generally withdrawn in individual portions after removing a final closure of the bag, e.g., a welding seam, that has been placed at the outer edge area of the top end of the bag by the fill material company. The reclosable device, e.g., in the form of an interlocking profile strip closure device, enables the user to reclose the bag each time after goods are withdrawn, or to reopen it for withdrawing fill material. In general, it is desired to design the reclosable device of the bag in an aroma-proof manner to retain the quality of the fill material. For this reason, it is necessary to provide a tight seal for the upper ends of the side gussets as well, such that with known gusseted bags of the type in question, the upper ends of the side gussets are closed as well when the bags are manufactured.

In a known gusseted bag of the above mentioned kind, this is accomplished in that the upper ends of the side gussets are closed by a separately welded sealing strip underneath the reclosable device, where said sealing strip, when welded, at the same time holds the respective side gusset end to one of the two bag walls. Although such weld connections can be made easily with regard to the bag material and the material of the sealing strips, because these materials are generally, at least in the area of the surfaces that are to be welded together, made of thermoplastic synthetic materials that can be welded well to one another, however, the use of separate sealing strips results in additional material expenditures, which adversely effects the manufacturing costs of a mass-produced item such as the gusseted bag in question. In addition, the circumstance that the sealing strips hold the upper ends of the side gussets to the respective wall when establishing the weld connection results in a narrowing of the fill opening of the bag, that has a negative effect both on the fill speed during machine filling of the bag in the filling plant and with regard to the end user, for the ability to completely empty the bag.

SUMMARY OF THE INVENTION

The invention has the objective to create a gusseted bag of the type mentioned above, where a closure of the upper ends of the side gussets is formed in a simple manner in the course of the bag manufacturing and under avoidance of an increased material expenditure, where at the same time said closure has no adverse effect on the filling and emptying properties of the bag.

According to the invention, this objective is accomplished in that the upper ends of the side gussets are closed by being welded together to themselves and underneath the reclosable device reach freely into the inner space of the bag.

An increased material expenditure such as is necessary with the known sealing strips is avoided with the welding of the upper ends of the side gussets to one another subject to the invention, while due to the circumstance that underneath the reclosable device the closed side gusset ends reach freely into the interior space of the bag, an adverse narrowing of the fill opening of the bag, which at the same time is the emptying opening for the consumer, is avoided. This allows for a steady and quick filling of the bag in the filling plant because the filling material runs into the bag on both sides of the side gussets that are free at their upper ends. Along with that comes an optimal opening of the side gussets by spreading flat towards the outside during filling and when the fill level rises. The free side gussets prove advantageous from a consumer point-of-view, because they avoid corners in the opening area that would retain fill material residue when emptying the bag.

Depending on the material condition of the bag, welding the upper side gusset ends to themselves can be carried out easily by applying a closing weld seam, preferably in the area of the upper cutting edge of the side gusset ends, which may run transversely towards the bottom end, between their two material layers, or where the upper region of the side gusset ends is folded onto one of the two halves of each side gusset, and the welding of the standing side gusset end to itself is carried out with the folded end region and the adjacent side gusset half. The upper end region of the side gussets may be folded along a folding line that starts at the outer edge of the side gusset halves and runs transversely to the bottom end, such that the folded end region exhibits the shape of a right angled triangle with a hypotenuse that is directed transversely to the inside of the bag.

The arrangement of the reclosable device in the top area of the bag that is free of side gussets ensures its easy attachment, e.g., by a welding process during the manufacture of the bag. Thus, the reclosable device can be attached to the interior side of the bag, for example, in the form of interlocking profile strips made of thermoplastic synthetics, in the simple manner that is familiar from flat bags. Such interlocking profile strips that can be closed by interlocking in a groove and tongue fashion are generally known. However, within the scope of the design of the invention, the reclosable device can also be formed by closure strips in the form of velcro-type strips or as a sliding or zipper-type closing device. Furthermore, within the scope of the invention it is also possible to select a reclosable device that is formed by a strip of a continuously adhesive material or a pressure sensitive material applied to the inside of the front and/or back wall of the bag. With the bag subject to the invention, this freedom of selection in the design of the reclosable device is ensured by having the reclosable device at a location entirely separate from the closure of the upper side gusset ends in the top area of the bag that is free of side gussets.

Additional features and advantages of the invention will become readily apparent from the claims and the following description in connection with the drawings, where an exemplary embodiment of the subject of the invention is schematically illustrated.

IN THE DRAWINGS

Figure 2:
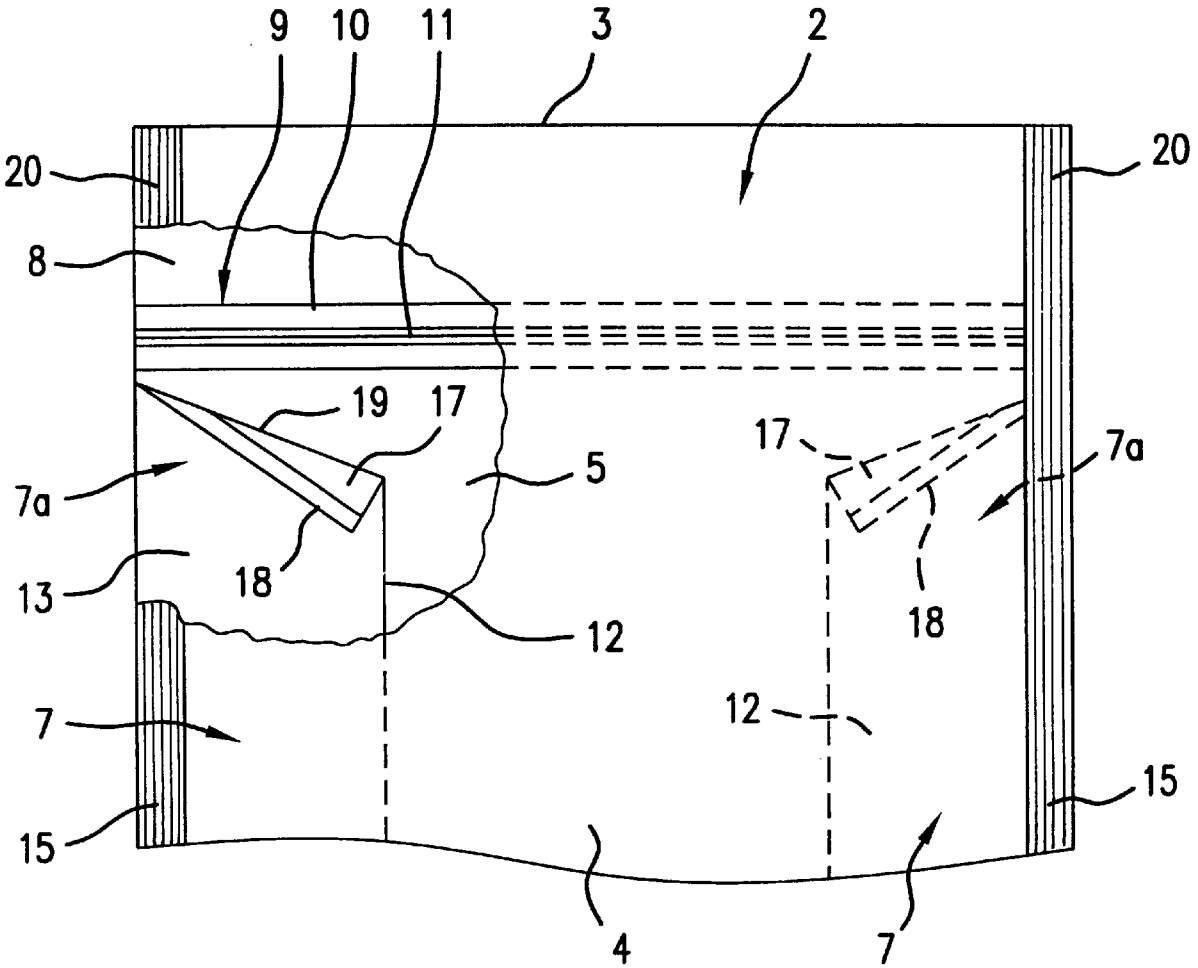

FIG. 1 shows a perspective presentation of a filled gusseted bag subject to the invention, FIG. 2 shows the front view of the upper region of a gusseted bag subject to the invention in its empty condition with a partially cut out front wall of the bag, and FIGS. 3*a*–3*d* show locking elements of a reclosable device.

DESCRIPTION OF THE PREFERRED EMBODIMENTS

The gusseted bag shown in the drawing can be made as a synthetic bag consisting of thermoplastic synthetic foil material, particularly a polyolefine such as polyethylene or polypropylene, or a composite material that carries at least on its interior side a layer of a thermoplastic synthetic that allows for welding, while one or more successive layers of the composite material towards the outer side as interim layers may exhibit a metal foil, e.g., an aluminum foil as a barrier material for aroma-proofing the bag.

In detail, the shown bag includes a closed bottom end 1 and a top end 2 that in the empty condition shown in FIG. 2 is open at the top and that will be closed only after filling the bag in the filling plant along a top edge 3 of the bag walls 4 by a welding seam 6, as is shown with the filled bag according to FIG. 1.

The bag wall 4 forms the front wall of the bag while bag wall 5 forms the rear wall of the bag. On both sides, side gussets 7 that stretch from the bottom end 1 to the top end 2 are inserted between these two walls and terminate at a distance underneath the upper edge 3 or the weld seam 6 of the bag. Thus, a top region 8 of the bag without side gussets is formed in the area between the upper ends 7*a* of the side gussets 7 and the upper edges 3 of the bag walls 4 and 5.

Figure 3A:
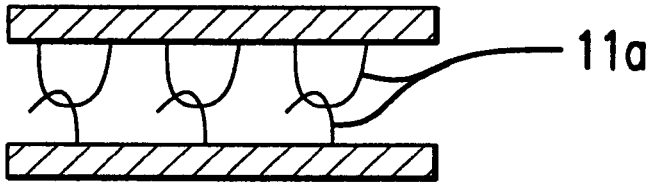
Figure 3B:
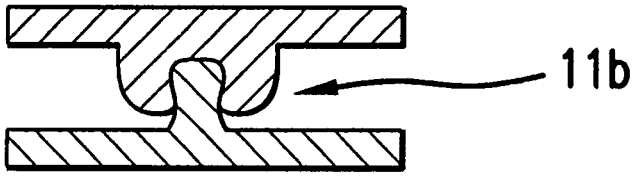
Figure 3C:
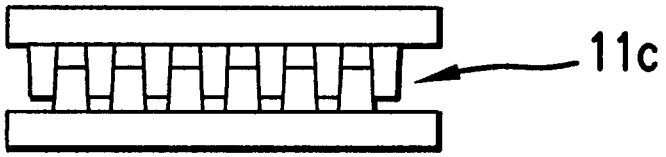
Figure 3D:
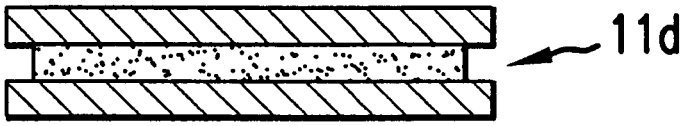

A reclosable device 9 is located in the top region 8 between the two bag walls 4, 5 that in the shown example includes two closing strips 10 that stretch across the entire width of the bag, where one strip is affixed to the front wall 4 of the bag and the other to the rear wall 5 of the bag by welding or hot-sealing. The closing strips 10 may be designed, for example, as matching interlocking profile strips that can be closed by interlocking the locking elements 11 in a groove and tongue fashion. The locking elements may be hook and loop elements 11*a* as shown in FIG. 3*a*, gliding elements 11*b* as shown in FIG. 3b, zipper elements 11*c* as shown in FIG. 3*c*, or adhesive or pressure sensitive elements 11*d* as shown in FIG. 3*d*, for examples. The reclosable device 9 is used by the consumer after separating the weld seam 6.

The side gussets 7 each include two side gusset halves 13 and 14 at both sides of their center gusset edge 12, where said halves are connected along the side weld seams 15, 16 to the front bag wall 4 or the rear bag wall 5. The weld seams 15, 16 continue in the top region 8 as one weld seam 20. In the empty condition of the bag according to FIG. 2, the two side gusset halves 13, 14 of each side gusset lay flat on one another in a light V-shape, while they are opened towards the outside by flat spreading in the filled condition of the bag according to FIG. 1 to give the filled bag a near parallel-epipedic form in its fill region.

The upper ends 7*a* of the side gussets 7 may be closed. To accomplish this, an upper region 17 of the side gussets end 7*a* is folded onto one of the two side gusset halves 13, 14. In this example side gusset half 13 is used. The two layers of the folded end region 17 are solidly welded to one another by a welding seam that runs along the upper cutting edges of the side gusset halves 13, 14 and to the adjacent interior side of the side gusset half 13. The side gussets 7 that are closed in this manner by being welded to themselves stretch with their folded end regions 17 underneath the reclosable device 9 freely into the interior space of the bag.

As the drawing shows, the upper end region 17 of the side gussets 7 is folded along a fold line 19 that starts at the outer edge of the side gusset half 14, which is defined by the side weld seam 15, and runs transversely towards the bottom end 1. The folded end region 17 of each side gusset has the shape of a right angled triangle, whose hypotenuse is directed towards the bottom end more or less transversely, according to the inclination angle of the fold line 19. This design simplifies both the filling of the bag as well as its emptying without wasting residual amounts of the fill by always retaining the tight closure at the end side of the upper side gusset ends 7*a*.

The closed bottom end 1 can have any design appropriate to the purpose of the bag and may, for example, exhibit the flat final weld 21 shown in FIG.1.

What we claim is:

1. Gusseted bag made of a flexible weldable material with a closed bottom end that at the inside top end is provided with a reclosable device, where side gussets that are inserted between the two bag walls that form the front bag wall and the rear bag wall stretch from the bottom end to the top end and terminate at a distance below the upper edge of the bag walls and thus define a top area of the bag without side gussets, where the reclosable device is formed between the two bag walls, said upper ends (7*a*) of the side gussets (7) being closed by welding to themselves and reach freely into the interior space of the bag underneath the reclosable device (9).

2. Gusseted bag as set forth in claim 1, wherein the weld of the upper side gusset ends (7*a*) with itself is formed by a closing weld seam between the two layers of the side gusset end (7*a*).

3. Gusseted bag as set forth in claim 1 or 2, wherein the upper region (17) of the ends (7*a*) of the side gussets (7) is folded onto a (13) of the two halves (13, 14) of each side gusset (7) and that the weld of the side gusset end (7*a*) with itself is formed with the folded end region (17) and the adjacent side gusset half (13).

4. Gusseted bag as set forth in claim 3, wherein the upper end region (17) of the side gussets (7) is folded along a fold line (19) that starts at the outer edge of the side gusset half (13) and runs transversely towards the bottom end (1).

5. Gusseted bag as set forth in claim 3, wherein the folded end region (17) exhibits the shape of a right angled triangle.

6. Gusseted bag as set forth in claim 3, wherein the reclosable device (9) is formed by two interlockable closing strips (10) that stretch across the entire width of the bag, where one strip is affixed to the front wall (4) of the bag and the other to the rear wall (5) of the bag.

7. Gusseted bag as set forth in claim 6, wherein the closing strips (10) are formed as interlocking profile strips that can be closed by interlocking the locking elements (11) in a groove and tongue fashion.

8. Gusseted bag as set forth in claim 6, wherein the closing strips (10) are formed as hook and loop strips.

9. Gusseted bag as set forth in claim 6, wherein the closing strips (10) are formed as a gliding closing device.

10. Gusseted bag as set forth in claim 6, wherein the reclosable device (9) is formed by a strip of a continuously adhesive material that stretches across the width of the bag and is applied to the inside of the front wall (4) and/or the back wall (5) of the bag.

11. Gusseted bag as set forth in claim 6, wherein the closing strips (10) are formed as a zipper closing device.

12. Gusseted bag as set forth in claim 6, wherein the closing strips (10) are formed as pressure sensitive strips.

* * * * *